US010246210B2

(12) United States Patent
Hermel

(10) Patent No.: US 10,246,210 B2
(45) Date of Patent: Apr. 2, 2019

(54) CONTAINER HAVING A PETALOID BASE AND GROOVE

(71) Applicant: SIDEL PARTICIPATIONS, Octeville sur Mer (FR)

(72) Inventor: Wilfried Hermel, Octeville sur Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 500 days.

(21) Appl. No.: 14/901,014

(22) PCT Filed: Apr. 22, 2014

(86) PCT No.: PCT/FR2014/050981
§ 371 (c)(1),
(2) Date: Dec. 22, 2015

(87) PCT Pub. No.: WO2014/207331
PCT Pub. Date: Dec. 31, 2014

(65) Prior Publication Data

US 2016/0144992 A1 May 26, 2016

(30) Foreign Application Priority Data

Jun. 25, 2013 (FR) ..... 13 56077

(51) Int. Cl.
*B65D 1/02* (2006.01)

(52) U.S. Cl.
CPC .... *B65D 1/0284* (2013.01); *B65D 2501/0036* (2013.01)

(58) Field of Classification Search
CPC ..... B65D 23/00; B65D 1/16; B65D 1/0284; B65D 2501/0036
(Continued)

(56) References Cited

U.S. PATENT DOCUMENTS 5,205,434 A * 4/1993 Brunson ..... B65D 1/0284 215/375
5,261,543 A * 11/1993 Ugarelli ..... B65D 1/0223 215/375
(Continued)

FOREIGN PATENT DOCUMENTS

EP 1 645 515 A1 4/2006
FR 2 904 808 A1 2/2008
(Continued)

OTHER PUBLICATIONS

International Search Report, dated Jul. 7, 2014, from corresponding PCT Application.

*Primary Examiner* — Ernesto Grano
(74) *Attorney, Agent, or Firm* — Young & Thompson

(57) ABSTRACT

A container (1) includes a body and a petaloid base (3) extending the body, the base (3) including feet (7) separated into pairs by recessed valleys (12) that extend radially to an edge (8), the base (3) further including a series of grooves (17) that extend radially, extending at least partially along the bottom of the valleys (13), in which:

the feet (7) extend axially to a height less than or equal to 1/5 of a radial extension of the bottom (3);

the bottom (3) includes a central dome (5), whose concave part is turned towards the outside of the container (1);

each groove (17) has an inner section (17A) that projects radially from the valley (12) and overlaps the dome (5), and an outer section (17B) that extends radially in the continuity of the inner section (17A), at the bottom of the respective valley (12).

14 Claims, 3 Drawing Sheets

(58) Field of Classification Search
USPC ..... 215/375
See application file for complete search history.

(56) References Cited

U.S. PATENT DOCUMENTS

| | | | | | |
|---|---|---|---|---|---|
| 5,454,481 | A * | 10/1995 | Hsu | B65D 1/0284 | 220/608 |
| 5,906,286 | A * | 5/1999 | Matsuno | B29C 49/12 | 215/373 |
| 5,988,416 | A * | 11/1999 | Cheng | B65D 1/0284 | 215/375 |
| 6,019,236 | A * | 2/2000 | Slat | B65D 1/0284 | 215/375 |
| 6,085,924 | A * | 7/2000 | Henderson | B65D 1/0284 | 215/373 |
| 6,112,924 | A * | 9/2000 | Zhang | B65D 1/0284 | 215/375 |
| 6,276,546 | B1 * | 8/2001 | Davis | B65D 1/0284 | 215/373 |
| 6,296,471 | B1 * | 10/2001 | Cheng | B29C 33/42 | 249/117 |
| D510,031 | S * | 9/2005 | Slat | D9/520 | |
| 7,959,997 | B2 * | 6/2011 | Takada | B65D 1/0284 | 428/34.1 |
| D656,026 | S * | 3/2012 | Quasters | D9/516 | |
| D676,325 | S * | 2/2013 | Quasters | D9/516 | |
| 2005/0127024 | A1 | 6/2005 | Darr | | |
| 2006/0175283 | A1 * | 8/2006 | Piccioli | B65C 9/067 | 215/375 |
| 2007/0045220 | A1 * | 3/2007 | Pedmo | B65D 1/0284 | 215/375 |
| 2008/0035601 | A1 | 2/2008 | Derrien | | |
| 2010/0032404 | A1 | 2/2010 | Colloud | | |
| 2010/0072165 | A1 * | 3/2010 | Schau | B65D 1/0284 | 215/371 |
| 2011/0309090 | A1 | 12/2011 | Derrien et al. | | |
| 2013/0062306 | A1 * | 3/2013 | Quasters | B65D 1/0284 | 215/375 |
| 2013/0264305 | A1 * | 10/2013 | Boukobza | B65D 1/0284 | 215/375 |
| 2014/0227399 | A1 * | 8/2014 | Wortmann | B65D 1/0284 | 426/106 |
| 2015/0034660 | A1 * | 2/2015 | Barel | B65D 1/0284 | 220/608 |

FOREIGN PATENT DOCUMENTS

| | | | |
|---|---|---|---|
| FR | 2 910 438 | A1 | 6/2008 |
| WO | 00/07886 | A1 | 2/2000 |
| WO | 03/091117 | A1 | 11/2003 |
| WO | 2011/058787 | A1 | 5/2011 |
| WO | 2012/069759 | A1 | 5/2012 |

* cited by examiner

CONTAINER HAVING A PETALOID BASE AND GROOVE

BACKGROUND

Field of Invention

The invention relates to the field of containers, particularly bottles or jars, manufactured by blow molding or stretch-blow molding from parisons of plastic material such as polyethylene terephthalate (PET).

Description of Related Art

A container generally comprises an open neck, through which the contents (ordinarily a liquid) are introduced, a body, which imparts to the container its volume, and a bottom, which closes the body opposite the neck and forms a base intended to ensure the stability and the support of the container when it rests on a surface.

Containers intended for carbonated beverages, in which the pressure of the gas dissolved in the liquid causes considerable mechanical stresses, are predominantly provided with large-height bottoms with a petaloid shape: the bottom comprises projecting feet, in the shape of petals, separated by convex wall portions, called hollows or valleys, which extend radially from a central zone of the bottom. The feet, of large height (i.e., in a ratio of about 1/2 with the diameter of the container), are intended to ensure the support of the container placed on a surface; the valleys are intended to absorb the forces (thermal, mechanical) exerted by the contents. An illustrative example of this type of bottom will be found in the international application WO 2012/069759 (SIDEL).

The petaloid-shaped bottom appears as a relatively successful solution exhibiting a good resistance to the strong internal pressures in the container (particularly as a result of the hemispherical shape of the valleys).

However, the petaloid-shaped bottom requires a considerable amount of material (a 0.5 l container with a standard petaloid-shaped bottom having a weight that is greater than or equal to about 18 g), as well as a relatively high blow molding pressure (on the order of 22 to 30 bars), to ensure a proper impression-taking of the feet and valleys.

These constraints tend to disqualify the petaloid-shaped bottom for flat-liquid-type applications (typically table water or non-carbonated beverages), for which both the blow molding pressure and the amount of material used (today on the order of 10 g at most for a 0.5 l container) are minimized.

It is becoming common for certain applications of flat liquids that are susceptible to oxidation (particularly fruit juices, but also certain plain waters) to remove the air above the flat liquid and to replace it with an inert gas (typically nitrogen). In practice, this operation is performed by adding a drop of liquefied inert gas to the surface of the flat liquid, immediately preceding the capping of the container. This operation causes an excess pressure in the container. Although seemingly slight (on the order of 0.5 to 1 bar), this excess pressure is enough to considerably increase the stresses that are exerted on the bottom, without, however, these stresses justifying the return to standard petaloid-shaped bottoms (i.e., of large height).

Now, a bottom provided with a simple concave arch, if it a priori meets the requirements of savings of material and of easy blow moldability, is not, however, able to support without significant deformation the stresses due to the doubled hydrostatic pressure of the pressure of the added neutral gas.

BRIEF SUMMARY OF THE INVENTION

Therefore, there is a need for a container whose bottom offers an increased resistance to the internal stresses relative to the ordinary arched bottoms, while not requiring as much material, nor a blow molding pressure that is as high, as an ordinary petaloid-shaped bottom.

For this purpose, a container of plastic material has been proposed that comprises a body and a petaloid-shaped bottom that extends the body, the bottom comprising a bottom wall of general convex shape toward the outside, from which feet formed by protrusions project, separated two at a time by portions of the bottom wall forming recessed valleys that extend radially to a periphery of the bottom, the bottom further comprising a series of radial extension grooves that extend at least partially at the bottom of the valleys:

- the feet extend axially over a height that is less than or equal to 1/5 of a radial extension of the bottom;
- the bottom comprises a central dome with concavity turned toward the outside of the container;
- each groove has an inner section that radially goes beyond the valley and straddles the dome, and an outer section that extends radially in the continuation of the inner section, at the bottom of the respective valley.

This bottom, which can be termed "mini-petaloid-shaped" given the ratio between the height of the feet and the transverse extension of the bottom, comparatively small with regard to a standard petaloid-shaped bottom, can be blow molded at lower pressures (on the order of, or less than, 25 bars), while offering good mechanical performance that makes it suitable for the addition of an inert gas under pressure (typically formed by vaporization of a drop of liquid nitrogen).

Various additional characteristics can be provided, alone or in combination:

- the inner section of the groove has a width that is greater than the outer section;
- each groove has a tapering contour from the inside to the outside of the bottom;
- each groove ends on the outside by a pointed outer end;
- the outer ends of the grooves are placed in a circle that has a diameter that is less than a radial extension of a standing plane defined by apexes of the feet;
- the grooves have a depth that gradually decreases from the inside to the outside of the bottom;
- each valley ends on the inside at an inner end spaced apart from the dome;
- the dome has a radial extension that is greater than or equal to one-fifth of the radial extension of the bottom;
- the dome has a rise that is greater than or equal to one-half of the height of the bottom;
- the feet have sides that border the valleys and that have an angular opening that gradually decreases from the inside to the outside of the bottom.

BRIEF DESCRIPTION OF THE DRAWINGS

Other objects and advantages of the invention will come to light from the description of an embodiment, given hereafter with reference to the accompanying drawings in which.

DETAILED DESCRIPTION OF THE PREFERRED EMBODIMENTS

Figure 1:
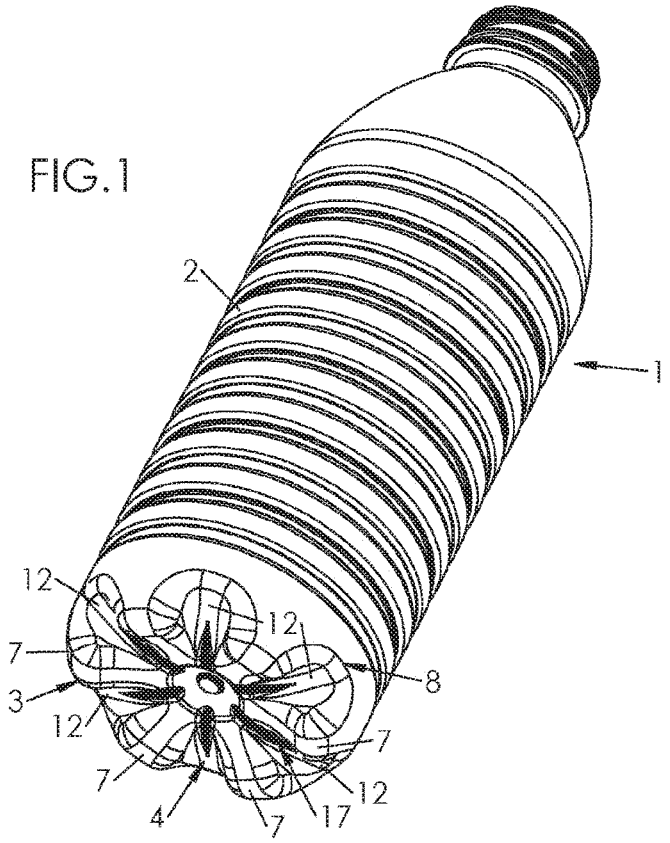
FIG. 1 is a bottom perspective view of a container provided with a petaloid-shaped bottom of small height.

Shown in a bottom perspective in FIG. 1 is a container 1—in this particular case a bottle—that is obtained by blow molding or stretch-blow molding from a preform of thermoplastic material, for example of polyethylene terephthalate (PET), previously heated.

The container 1 extends along a main axis X and comprises a side wall 2 called body, and a bottom 3 that extends and closes the body 2 at its lower end.

The bottom 3 is petaloid-shaped and comprises a bottom wall 4 with a general shape that is convex toward the outside of the container 1 (i.e., downward when the container 1 is set flat), which extends from a central dome 5 with concavity turned toward the outside of the container 1. In the center of the dome 5, a button 6 coming from injection extends in axial projection, the material of which has remained approximately amorphous during the forming of the container 1. The dome 5 in particular has the function of drawing the material to the center of the bottom, so as to increase its crystallinity and therefore its mechanical strength.

Figure 4:
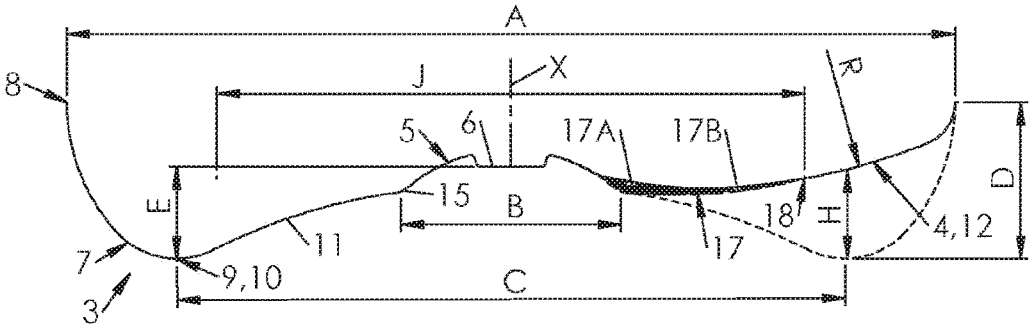
FIG. 4 is a cutaway view of the bottom of the container of FIG. 3, along the cutting plane IV-IV.

The bottom 3 furthermore comprises a series of feet 7 formed by protrusions in axial projection from the bottom wall 4 toward the outside of the container 1. The feet 7 extend radially from the central dome 5 to a periphery 8 of the bottom 3 where it is connected to the body 2. The overall radial extension of the bottom 3 is denoted as A, measured perpendicular to the axis X in the area of its periphery 8 (FIG. 4). In the case of a container 1 having a cylindrical body 2 (as in the example illustrated), the radial extension A is its diameter. Furthermore, the radial extension (in this particular case the diameter) of the dome 5 is denoted as B. This radial extension B is preferably greater than or equal to one-fifth of the radial extension A of the bottom 3. According to a preferred embodiment, illustrated in the figures, the diameter B of the dome is on the order of one-fourth of the diameter A of the bottom 3:

$$B \cong 0.25 \cdot A$$

Figure 2:
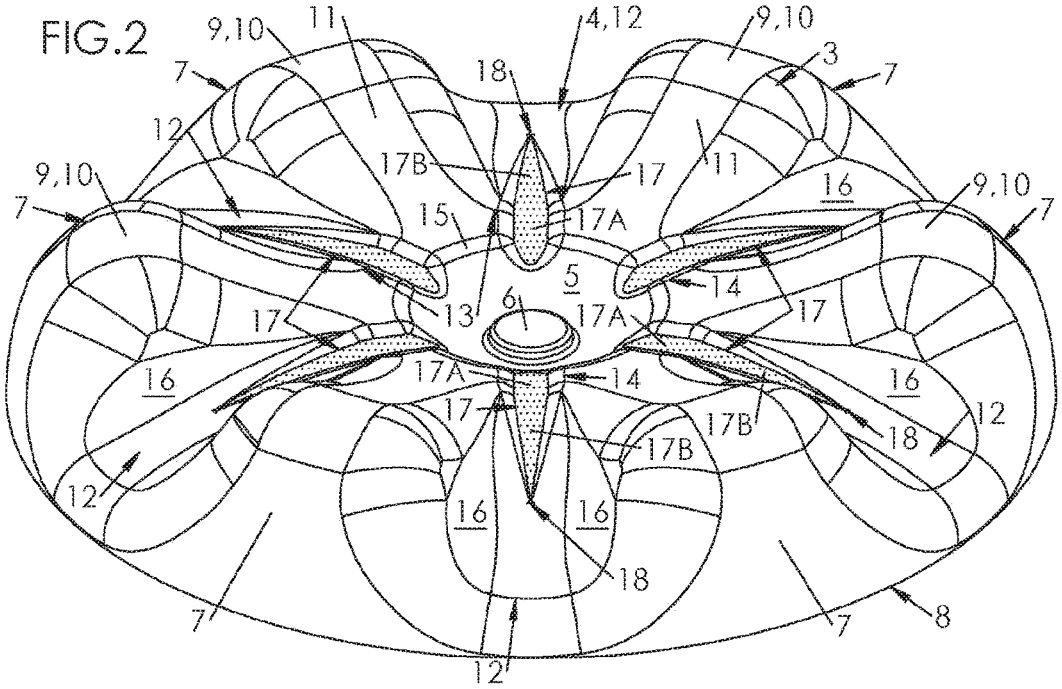
FIG. 2 is a perspective view, on an enlarged scale and along another angle of view, showing the bottom of the container of FIG. 1.
Figure 3:
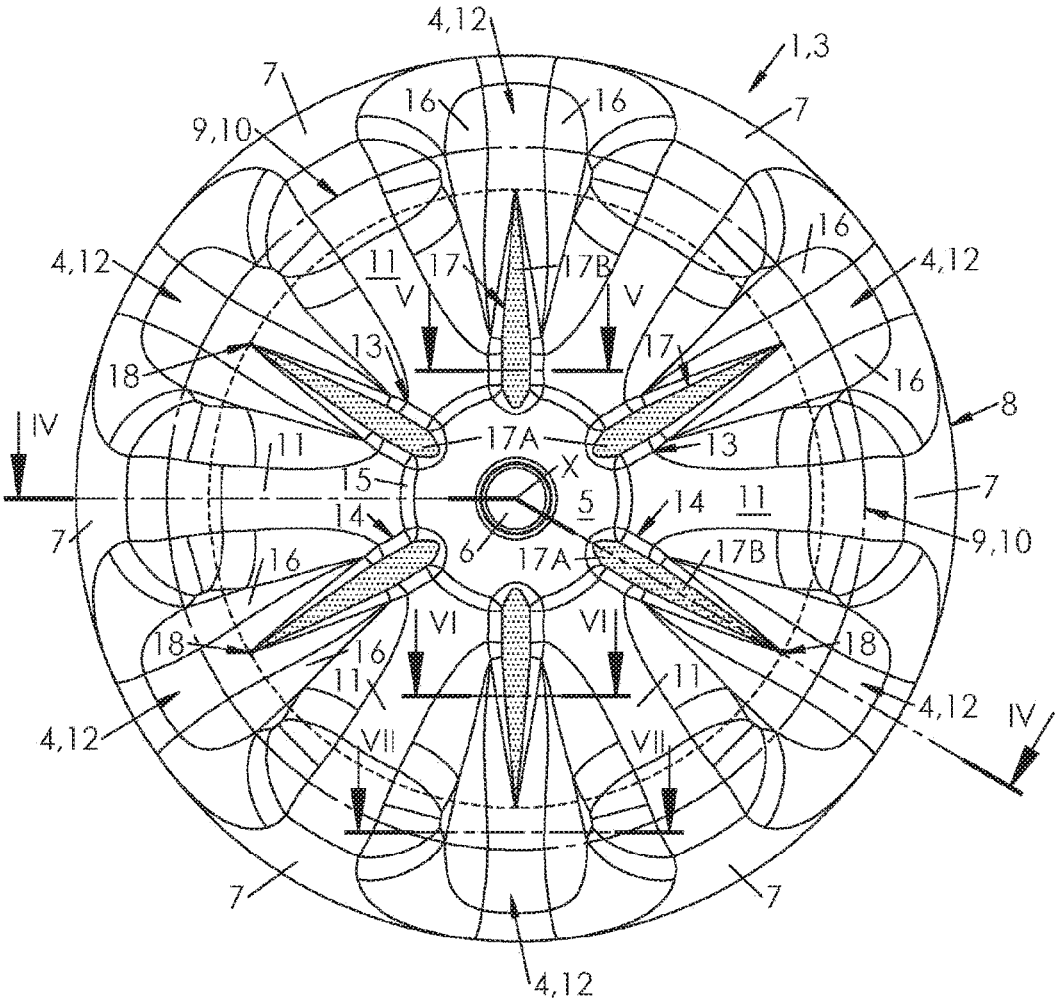
FIG. 3 is a plan view from below of the bottom of the container of the preceding figures.

The parts that project the most or apexes 9 of the feet 7 are coplanar and together form a standing plane 10 by which the container 1 can rest on a flat surface (for example a table). As can be seen in FIGS. 2 and 3, the standing plane 10 (indicated in FIG. 3 by a dashed-line circle) is situated radially set back relative to the periphery 8. The radial extension (i.e., the diameter in the example illustrated) of the standing plane 10 is denoted as C, and the total height of the bottom 3 is denoted as D (which corresponds to that of the feet 7), measured axially from the standing plane 10 to the periphery 8 of the bottom 3.

As can be clearly seen in FIGS. 2 and 3, the feet 7 gradually taper from the inside to the outside of the container 1 (i.e., downward) and while widening from the central dome 5 to the periphery 8.

Each foot 7 has an end face 11 that extends in a gentle slope from the dome 5 to the apex 9 and that, as can be seen in FIG. 3, has an approximately constant width.

The axial extension of the end face 11 (also called rise or bottom guard) is denoted as E, measured between the standing plane 10 and the center of the dome 5, in this particular case the button 6. The rise E is less than the height D of the bottom 3, but without being insignificant relative to it. More specifically, the rise E is greater than or equal to one-half of the height D of the bottom 3:

$$E \geq \frac{D}{2}$$

According to a preferred embodiment illustrated in the figures, the rise E of the bottom is about 60% of the height D of the bottom 3:

$$E \cong 0.6 \cdot D$$

The considerable value of the rise E with regard to the small height of the bottom 3 results from the presence of the dome 5. This considerable rise E increases the mechanical strength of the bottom 3.

As can be seen clearly in FIGS. 2 and 3, the feet 7 are separated two at a time by portions 12 of the bottom wall 4 called valleys, which extend radially in a star-shaped manner from the central button 6 to the periphery 8.

The valleys 12 extend recessed between the feet 7 that they separate two at a time. The valleys 12 are approximately straight in cross-section (i.e., along a plane perpendicular to the radial direction, see FIGS. 6 and 7). Furthermore, as can also be seen in the sections of FIGS. 6 and 7, the valleys 12 have an approximately constant width (measured transversely) from an inner zone near the dome 5 (FIG. 6) to an outer zone near the periphery 8 (FIG. 7).

As can be seen in FIGS. 2 and 3, the valleys 12 are not directly connected to the dome 5 but end on the inside at an inner end 13 that is separate from it, an intermediate space 14 thus being defined between the end 13 and an outer edge 15 of the dome 5.

It is seen clearly in FIGS. 2 and 3 that the feet 7 are equal in number to the valleys 12. In the example illustrated, the bottom 3 comprises six feet 7 and six valleys 12, regularly alternating and distributed in a star shape. This number constitutes a good compromise; it could, however, be lower (but greater than or equal to three), or higher (but preferably less than or equal to nine).

Each foot 7 has two approximately flat sides 16 that each laterally border a valley 12. As can be seen in FIG. 4, the sides 16 are not vertical (because the bottom 3 would then be difficult, indeed impossible, to blow mold), but inclined while opening from the valley 12 toward the outside. The angular opening between the sides 16 in the vicinity of the dome 5 (FIG. 6) is denoted as F, and the angular opening between the sides 16 in the vicinity of the periphery 8 (FIG. 7) is denoted as G, without taking into account the connecting beads between the sides 16 and the valley 12 or the end face 11 of the foot 7.

Figure 6:
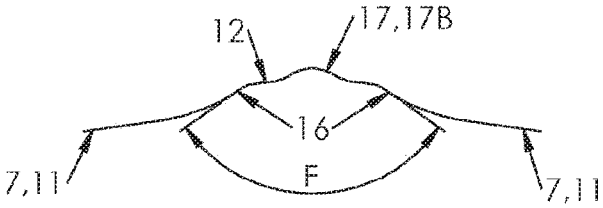
FIG. 6 is a detail view in cross-section along the cutting plane VI-VI of FIG. 3.
Figure 7:
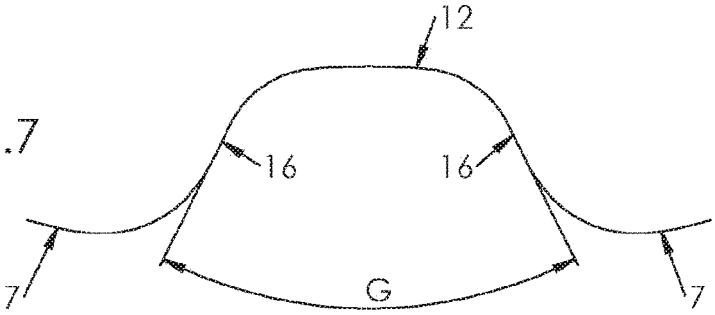
FIG. 7 is a detail view in cross-section along the cutting plane VII-VII of FIG. 3

As can be noted in FIGS. 6 and 7, the angular opening of the sides 16 is variable. More specifically, the angular opening of the sides 16 gradually decreases from the inside to the outside of the bottom 3 (i.e., from the axis X to the periphery 8), the angular opening F being greater than the angular opening G, which means that the sides 16 gradually are closing from the dome 5 to the periphery 8. According to a particular embodiment (illustrated in FIGS. 6 and 7), the angular opening F is about double the angular opening G.

This variation of angular opening makes it possible to widen the feet 7 toward the periphery 8, enhancing the stability of the container 1, and the strength of the feet 7, particularly during the palletizing of the container 1.

The bottom 3 can be referred to as "petaloid-shaped" because of its structure made of an alternation of projecting feet 7 and recessed valleys 12. However, its low height D/diameter A ratio disqualifies it for carbonated applications (typically for carbonated beverages). This ratio is actually less than or equal to 1/5:

$$\frac{D}{A} \leq \frac{1}{5}$$

A standard petaloid-shaped bottom would have such a ratio of about 1/2. This bottom 3, which can be referred to as "mini-petaloid-shaped" because of its low height D/diameter A ratio, is intended rather for applications of the flat liquid type that are associated with the addition, immediately after filling and before capping, of a drop of liquid nitrogen whose vaporization puts the contents of the container under excess pressure.

The valleys 12 are in addition relatively flat, their radius R of curvature, measured radially (FIG. 4), being large with regard to the diameter A of the bottom 3. More specifically, the radius R of curvature of the valleys 12 is preferably greater than or equal to the diameter A of the bottom 3:

$R \geq A$

According to a preferred embodiment illustrated in the figures, the radius R of curvature of the valleys is approximately equal to the diameter A of the bottom 3:

$R \cong A$

Furthermore, the average axial depth of each valley 12 is denoted as H, i.e., the distance, measured parallel to the axis X, between the apex 9 of the feet 7 and the point of the valley 12 located at the diameter C, vertically from the apex 9 (see FIG. 4). H is preferably less than or equal to the rise E:

$H \leq E$

Moreover, the depth H is less than or equal to about 1/8 of the radial extension A of the bottom 3:

$$\frac{H}{E} \leq \frac{1}{8}$$

With, preferably (as in the example illustrated):

$$H \cong \frac{A}{10}$$

This ratio is smaller than that of a standard petaloid-shaped bottom, for which it is on the order of 1/5.

So as to offer a better mechanical strength to the deformations resulting from the stresses due to such an excess pressure (which is added to the hydrostatic pressure of the liquid), the bottom 3 comprises a series of radial extension grooves 17, which extend at least partially to the bottom of the valleys 12. For better visibility, in FIGS. 1 to 4, the grooves 17 have been shaded with a dot pattern.

More specifically, each groove 17 has an inner section 17A, which radially goes beyond the valley 12 and straddles the dome 5, and an outer section 17B that extends radially in the continuation of the inner section 17A, at the bottom of the respective valley 12. As is clearly seen in FIGS. 2 and 3, the grooves 17 are centered relative to the valleys 12, i.e., each groove 17 extends along a median radial line of the respective valley 12. The inner section 17A covers the space 14 separating the inner end 13 of the valley 12 and the dome 5.

Each groove 17 is recessed toward the inside of the container 1 and has, in cross-section (FIGS. 5 and 6), a curved profile with concavity turned toward the outside. As is seen in FIGS. 2 and 3, each groove 17 has, when seen from below (see FIG. 3), a profile that is tapering from the inside to the outside of the bottom 3, i.e., from the dome 5 to the periphery 8, the inner section 17A being wider than the outer section 17B.

According to a preferred embodiment illustrated in the figures, each groove 17 has, when seen from below, a spear-shaped contour. Each groove 17 ends, toward the periphery 8, by a pointed outer end 18, at a distance from the axis X that is less than or equal to the radius of the standing plane (i.e., C/2). In other words, the outer ends 18 of the grooves 17 are placed in a circle (in broken lines in FIG. 3) that has a diameter, denoted as J, less than or equal to the diameter C of the standing plane:

$J \leq C$

According to a particular embodiment, the diameter J of the circle in which the outer ends 18 of the grooves 17 are placed is on the order of 70% of the overall diameter A of the bottom:

$J \cong 0.7 \cdot A$

Figure 5:
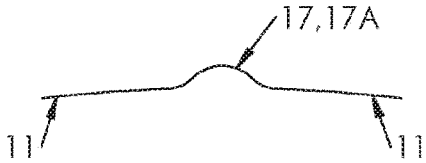
FIG. 5 is a detail cutaway view of the bottom of the container of FIG. 3, along the cutting plane V-V.

Also, as illustrated in FIGS. 5 and 6, the depth of the grooves 17, measured axially, gradually decreases from the inside to the outside of the bottom 3, the depth of the inner section 17A being greater than that of the outer section 17B.

The grooves 17 have the function of making the bottom 3 rigid. Under the effect of mechanical stresses exerted on the container 1 (particularly under the effect of the pressure prevailing in the container 1 that is filled with a flat liquid topped with a neutral gas at a relative pressure of typically between 1 and 2 bars), the bottom 3 is slightly deformed, the grooves 17 ensuring a distribution of the forces from the dome 5 to the valleys 12.

As a result of the connection that they make between the dome 5 and the valleys 12, the grooves 17:

- restrict the collapse of the dome 5, it being suspended in the valleys 12 by grooves 17; in other words, the rise E is kept approximately constant under the application of the above-mentioned stresses, the grooves 17 performing a function of arms for suspension of the dome 5;
- ensure a distribution of the stresses over the entire bottom 3, and in particular an at least partial transfer of the stresses experienced by the central dome 5 to the valleys 12, themselves made rigid laterally by the sides 16 and radially by their own spherical shape.

Under the effect of a pressure in the container 1, a slight accentuating (i.e., a reduction) of the radius R of curvature of the valleys 12, which causes a slight rocking of the outer section 17B of the grooves 17 toward the outside around the inner end 13 of the valley 12, this end 13 thus playing the role of axis of articulation of the grooves 17, is noted. This leads, by lever effect, to a reverse rocking of the inner section 17A toward the inside of the container 1, which tends to displace axially the dome 5 toward the inside of the container 1. A good mechanical strength of the bottom 3 that is subject to the above-mentioned pressure stresses results therefrom.

The invention claimed is:

1. A container (1) made of plastic material comprising a body (2) and a petaloid-shaped bottom (3) extending the body (2), the petaloid-shaped bottom (3) comprising a bottom wall (4) of general convex shape toward the outside, from which feet (7) formed by protrusions project, separated two at a time by portions of the bottom wall forming recessed valleys (12) that extend radially to a periphery (8) of the petaloid-shaped bottom (3), the petaloid-shaped bottom (3) further comprising a series of radial extension grooves (17) that extend at least partially at the bottom of the recessed valleys (12), wherein:

the feet (7) extend axially over a height (D) that is less than or equal to 1/5 of a radial extension (A) of the petaloid-shaped bottom (3), the height (D) being measured axially from a standing plane (10) to the periphery (8) of the petaloid-shaped bottom (3);

the petaloid-shaped bottom (3) comprises a central dome (5) with concavity turned toward the outside of the container (1);

each of the series of radial extension grooves (17) has an inner section (17A) that radially goes beyond a respective one of the recessed valleys (12) and straddles the central dome (5), and an outer section (17B) that extends radially in the continuation of the inner section (17A), at the bottom of the respective one of the recessed valleys (12), wherein the inner section (17A) of the of the series of radial extension grooves (17) has a width greater than the outer section (17B), wherein each of the series of radial extension grooves (17) ends on the outside by a pointed outer end (18), and wherein the outer ends (18) of each of the series of radial extension grooves (17) are placed in a circle that has a diameter (J) that is less than a radial extension (C) of a standing plane (10) defined by apexes (9) of the feet (7).

2. The container (1) according to claim 1, wherein each of the series of radial extension grooves (17) has a contour that is tapering from the inside to the outside of the petaloid-shaped bottom (3).

3. The container (1) according to claim 1, wherein each of the series of radial extension grooves (17)has a depth that gradually decreases from the inside to the outside of the petaloid-shaped bottom (3).

4. The container (1) according to claim 1, wherein each of the recessed valleys ends on the inside at an inner end that is separate from the central dome.

5. The container (1) according to claim 1, wherein the central dome (5) has a radial extension that is greater than or equal to one-fifth of the radial extension of the petaloid-shaped bottom (3).

6. The container (1) according to claim 1, wherein the central dome (5) has a rise that is greater than or equal to one-half of a height of the bottom.

7. The container (1) according to claim 1, wherein the feet (7) have sides (16) that border the recessed valleys (12) and that have an angular opening (F, G) that gradually decreases from the inside to the outside of the petaloid-shaped bottom (3).

8. The container (1) according to claim 3, wherein each of the series of radial extension grooves (17) has a contour that is tapering from the inside to the outside of the petaloid-shaped bottom (3).

9. A container (1) made of plastic material comprising a body (2) and a petaloid-shaped bottom (3) extending the body (2), the petaloid-shaped bottom (3) comprising a bottom wall (4) of general convex shape toward the outside, from which feet (7) formed by protrusions project, separated two at a time by portions of the bottom wall forming recessed valleys (12) that extend radially to a periphery (8) of the petaloid-shaped bottom (3), the bottom (3) further comprising a series of radial extension grooves (17) that extend at least partially at the bottom of the recessed valleys (12), wherein, the feet (7) extend axially over a height (D) that is less than or equal to 1/5 of a radial extension (A) of the petaloid-shaped bottom (3), the height (D) being measured axially from a standing plane (10) to the periphery (8) of the petaloid-shaped bottom (3);

the petaloid-shaped bottom (3) comprises a central dome (5) with concavity turned toward the outside of the container (1);

each of the series of radial extension grooves (17) has an inner section (17A) that radially goes beyond a respective one of the recessed valleys (12) and straddles the central dome (5), and an outer section (17B) that extends radially in the continuation of the inner section (17A), at the bottom of the respective one of the recessed valleys (12), wherein each of the series of radial extension grooves (17) has a contour that is tapering from the inside to the outside of the petaloid-shaped bottom (3), wherein each of the series of radial extension grooves (17) ends on the outside by a pointed outer end (18), and wherein the outer ends (18) each of the series of radial extension grooves (17) are placed in a circle that has a diameter (J) that is less than a radial extension (C) of a standing plane (10) defined by apexes (9) of the feet (7).

10. The container (1) according to claim 9, wherein each of series of radial extension grooves (17) has a depth that gradually decreases from the inside to the outside of the petaloid-shaped bottom (3).

11. The container (1) according to claim 9, wherein each of the recessed valleys ends on the inside at an inner end that is separate from the central dome.

12. The container (1) according to claim 9, wherein the central dome (5) has a radial extension that is greater than or equal to one-fifth of the radial extension of the petaloid-shaped bottom (3).

13. The container (1) according to claim 9, wherein the central dome (5) has a rise that is greater than or equal to one-half of a height of the bottom.

14. The container (1) according to claim 9, wherein the feet (7) have sides (16) that border the recessed valleys (12) and that have an angular opening (F, G) that gradually decreases from the inside to the outside of the petaloid-shaped bottom (3).

* * * * *